US007563087B2

(12) United States Patent
Van Norman et al.

(10) Patent No.: US 7,563,087 B2
(45) Date of Patent: Jul. 21, 2009

(54) PUMP ROTOR SEAL APPARATUS AND METHOD

(75) Inventors: Drew J. Van Norman, Whitewater, WI (US); Curt Hagen, Delavan, WI (US)

(73) Assignee: SPX Corporation, Charlotte, NC (US)

( * ) Notice: Subject to any disclaimer, the term of this patent is extended or adjusted under 35 U.S.C. 154(b) by 464 days.

(21) Appl. No.: 11/405,525

(22) Filed: Apr. 18, 2006

(65) Prior Publication Data

US 2007/0243091 A1 Oct. 18, 2007

(51) Int. Cl.
*F04C 2/00* (2006.01)
*F04C 27/02* (2006.01)
*F04C 29/02* (2006.01)

(52) U.S. Cl. ..... 418/102; 418/104; 418/141; 418/191

(58) Field of Classification Search ..... 418/102, 418/104, 131–133, 141, 191, 206.1, 201.1, 418/55.1, 55.5, 57
See application file for complete search history.

(56) References Cited

U.S. PATENT DOCUMENTS 4,153,400 A * 5/1979 Morita ..... 418/102
4,580,951 A * 4/1986 Carleton et al. ..... 418/102
5,449,280 A * 9/1995 Maki et al. ..... 418/133
6,200,117 B1 * 3/2001 Brown ..... 418/206.6
6,464,481 B2 * 10/2002 Tsubai et al. ..... 418/55.6

* cited by examiner

*Primary Examiner*—Theresa Trieu
(74) *Attorney, Agent, or Firm*—Baker & Hostetler LLP

(57) ABSTRACT

An improved pump and pumping method includes a circumferential positive displacement pump having two counter rotating rotors. A clearance gap is defined between the rotor shaft, and a body hub portion of the body that forms the chamber.

18 Claims, 6 Drawing Sheets

PUMP ROTOR SEAL APPARATUS AND METHOD

FIELD OF THE INVENTION

The invention pertains generally to the field of pumps and pumping devices and methods. More particularly, the invention pertains to external circumferential rotary piston pumps which use two counter-rotating rotors inside a housing to force material from an inlet to an outlet.

BACKGROUND OF THE INVENTION

Pumps and pumping devices are in wide use in industry. For example, one type of pump used in industries such as, for example, automotive paints, paper coatings, and other industrial processes is a positive displacement pump. One type of positive displacement pump is a rotary two-rotor pump in the form of an external circumferential piston pump.

An exemplary pump of this type includes a body defining a chamber having an inlet and outlet. Inside the chamber are disposed two counter rotating rotors. The rotors are driven by a motor and gear box to force the material from the inlet to the outlet.

An example of such a pump is depicted in FIG. 4. The pump 1 includes a first rotor 10 and a second rotor 12 disposed in a chamber defined by a housing body 14 which serves as a housing in combination with an end plate 15. The first rotor 10 is driven by a drive shaft 16 and a fastening nut 17 on the shaft end, and the second rotor 12 is driven by a shaft not visible in FIG. 4 and held by a similar nut 17. FIG. 4 also depicts an inlet 20 and outlet 22.

A body hub clearance gap 24 exists between the rotating rotor 10 and a stationary projection referred to as a body hub 26 that is part of the housing body 14. The rotors 10 and 12 are driven by a gear box 28.

FIG. 5 is an external view of the pump 1, indicating the section line through which the sectional views in the other drawing figures are taken.

Turning to the section view of FIG. 6, the prior art pump 1 is further illustrated. In particular, in this figure it can be seen that a seal chamber 30 is defined between an inner face 34 of the body hub 32 and an outer face 36 of the rotor 10 which is a central mounting shaft portion of the rotor 10.

The dimensions of the body hub clearance gap 24 in the prior art are important to volumetric efficiency and pump performance. This is due to a relatively small sealing area that exists at the body hub clearance gap 24 and also to the location of the clearance gap 24 in the pumping path between the inlet 20 and outlet 22.

The body hub 32 and the rotor 10 have surfaces that form the body hub clearance gap 24 which are subject to high fluid velocity that sometimes results in rapid wear, especially when the pumped material contains abrasive particles. In certain applications such as, for example, automotive paint and paper coatings, the abrasive wear can dramatically reduce the useful service life of the pump.

The body hub clearance gap 24 is a location of sliding frictional contact, or near-contact, between the end tip 25 of the body hub 32 and an exposed axial face of the rotor 10. This sliding contact, or near-contact, accomplishes an imperfect "seal" of the contact area. This "seal" is subject to wear over time.

Referring to further to FIG. 6, it can be noted that during operation, while the pump is moving fluid from the inlet 20 to the outlet 22, the pressure of the fluid on the outlet side 22 is raised so that the pressure is higher at the outlet side 22 than the inlet side 20. This pressure differential (between the outlet side 22 past the rotors 10 and 12, compared to the inlet side 20 before the rotors 10 and 12), causes the pumped fluid to tend to leak back towards the inlet side 20 through the body hub clearance gap 24.

Although the body hub clearance gap 24 is actually a toroidal ring in its overall shape, the section view of FIG. 6 illustrates that the body hub clearance gap 24 can be thought of two body hub clearance gaps, one gap indicated at 24 and the other gap indicated at 25. The pumped fluid thus can be thought of as having two successive leak paths which the fluid can be thought of as leaking through in a serial fashion.

It would be desirable to reduce one or both of these leak paths at each rotor if possible. Accordingly, it would be desirable to reduce the pressure on the seal, referred to as a seal pressure, so that less material leaks through the clearance gap 24, and so that in the case of abrasive materials, reduction of the wear or erosion of the components in the area of the clearance gap 24 would occur. Wear in this area is undesirable because it reduces pump efficiency over the long term.

Accordingly, it is desirable to provide a method and apparatus that can yield improved performance and/or wear characteristics in a circumferential piston pump.

SUMMARY OF THE INVENTION

The foregoing needs are met, to a great extent, by the present invention, wherein in one aspect a positive displacement dual rotor pumping apparatus and method is provided that in some embodiments yields improved performance and/or wear characteristics in a circumferential positive displacement pump.

In accordance with one embodiment of the present invention, a pump, features a body forming a chamber; at least one rotor rotating in the chamber, the rotor having a shaft with a cylindrical outward face that has a first outer diameter portion and a second outer diameter portion, with a shoulder between the first outer diameter portion and the second outer diameter portion; and a body hub portion extending from the body and oriented axially and having a cylindrical inner diameter face in rotational sliding contact with one of the first or second outer diameter portions of the shaft.

In accordance with another embodiment of the present invention, a pump, features a means for defining a chamber; pumping means comprising at least one rotor rotating in the chamber, the rotor having a shaft with a cylindrical outward face that has a first outer diameter portion and a second outer diameter portion, with a shoulder between the first outer diameter portion and the second outer diameter portion; and a body hub extending in the chamber and oriented axially and having a cylindrical inner diameter face in rotational sliding contact with one of the first or second outer diameter portion of the shaft.

In accordance with yet another embodiment of the present invention, a pump, features a body forming a chamber; at least one rotor rotating in the chamber, the rotor having a shaft portion having a cylindrical outward face; and a body hub extending from the body and oriented axially and having a cylindrical inner diameter face having a third inner diameter portion and a fourth inner diameter portion, with a shoulder between the third inner diameter portion and the fourth inner diameter portion, and the third inner diameter portion in rotational sliding contact with the outward face of the shaft.

In accordance with yet another embodiment of the present invention, a pump, features a means for defining a chamber; pumping means comprising at least one rotor rotating in the chamber, the rotor having a shaft with a cylindrical outward face; and a body hub extending from the body and oriented axially and having a cylindrical inner diameter face having a third inner diameter portion and a fourth inner diameter portion, with a shoulder between the third inner diameter portion and the fourth inner diameter portion, and the third inner diameter portion in rotational sliding contact with the outward face of the shaft.

In accordance with yet another embodiment of the present invention, a method of pumping material using at least one rotor in a body forming a chamber, features rotating at least one rotor in the chamber, the rotor having a shaft with a cylindrical outward face that has a first outer diameter portion and a second outer diameter portion, with a shoulder between the first outer diameter portion and the second outer diameter portion, wherein the body has a body hub extending from the body and oriented axially and having a cylindrical inner diameter face in rotational sliding contact with one of the first or second outer diameter portions of the shaft.

In accordance with yet another embodiment of the present invention, a method of pumping material using at least one rotor in a body forming a chamber, features rotating at least one rotor in the chamber, the rotor having a shaft portion with a cylindrical outward face, wherein the body has a body hub extending from the body and oriented axially and having a cylindrical inner diameter face having a third diameter portion and a fourth diameter portion, with a shoulder defined between the third diameter portion and the fourth diameter portion, and the third diameter portion in rotational sliding contact with the outward face of the shaft.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
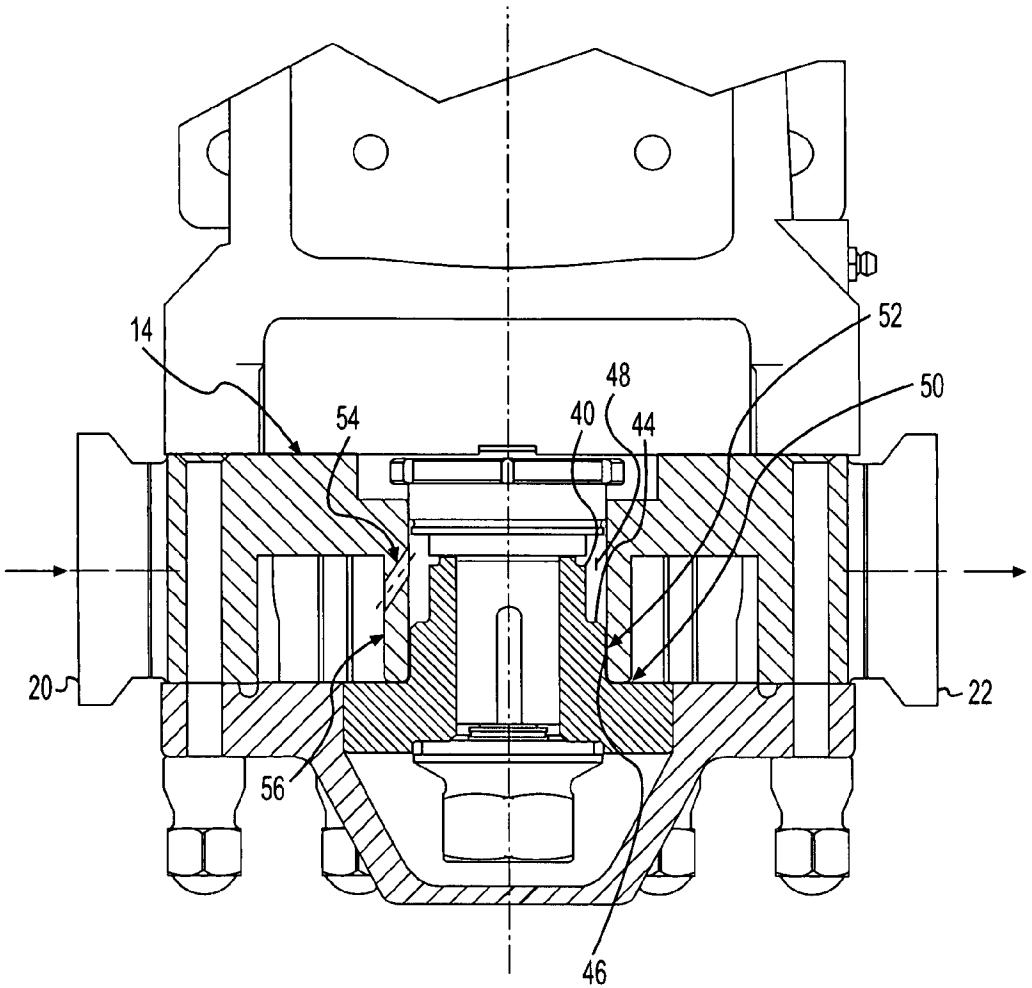
FIG. 1 is a sectional view, taken through line 1-1 in FIG. 5, of a first preferred embodiment of the present invention.

The foregoing needs are met, to a great extent, by the present invention, wherein in one aspect a positive displacement dual rotor pumping apparatus and method is provided that in some embodiments yields improved performance and/or wear characteristics in a circumferential displacement pump.

Some preferred embodiments will now be described with reference to the drawing figures in which like reference numbers refer to like parts through out.

Figure 4:
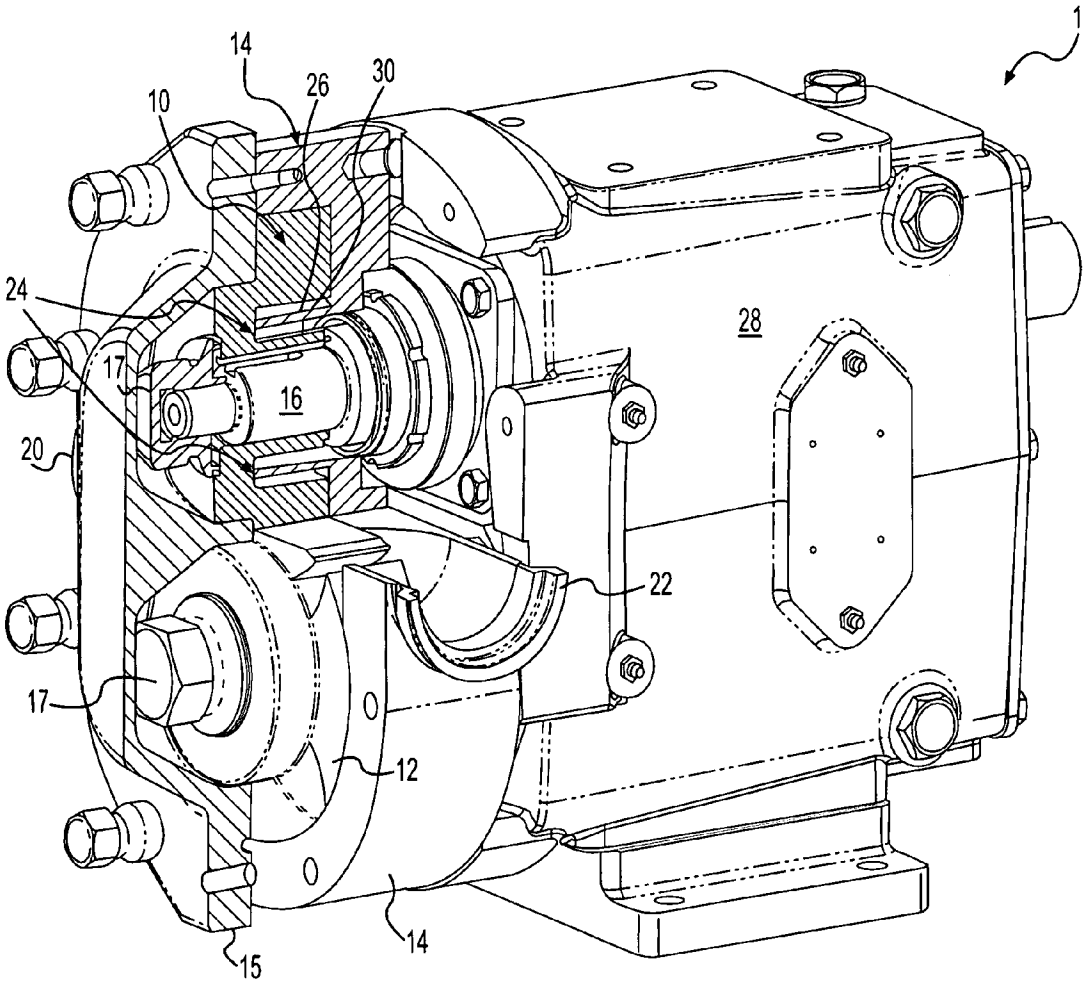
PRIOR ART FIG. 4
FIG. 4 is a cut away perspective view of a prior art pump of a type suitable for embodiments on the present invention.
Figure 5:
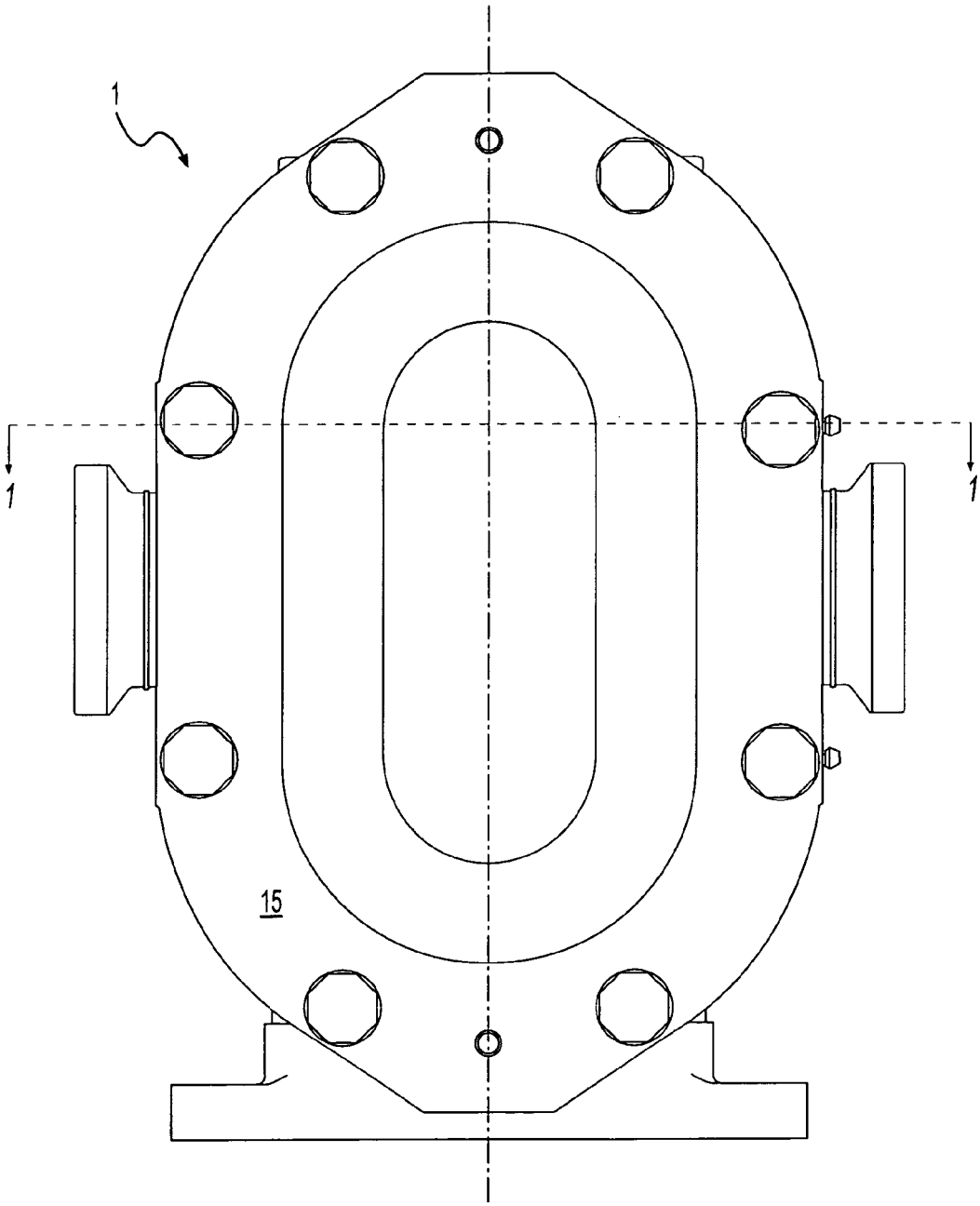
PRIOR ART FIG. 5
FIG. 5 is a side view of the pump of FIG. 4.
Figure 6:
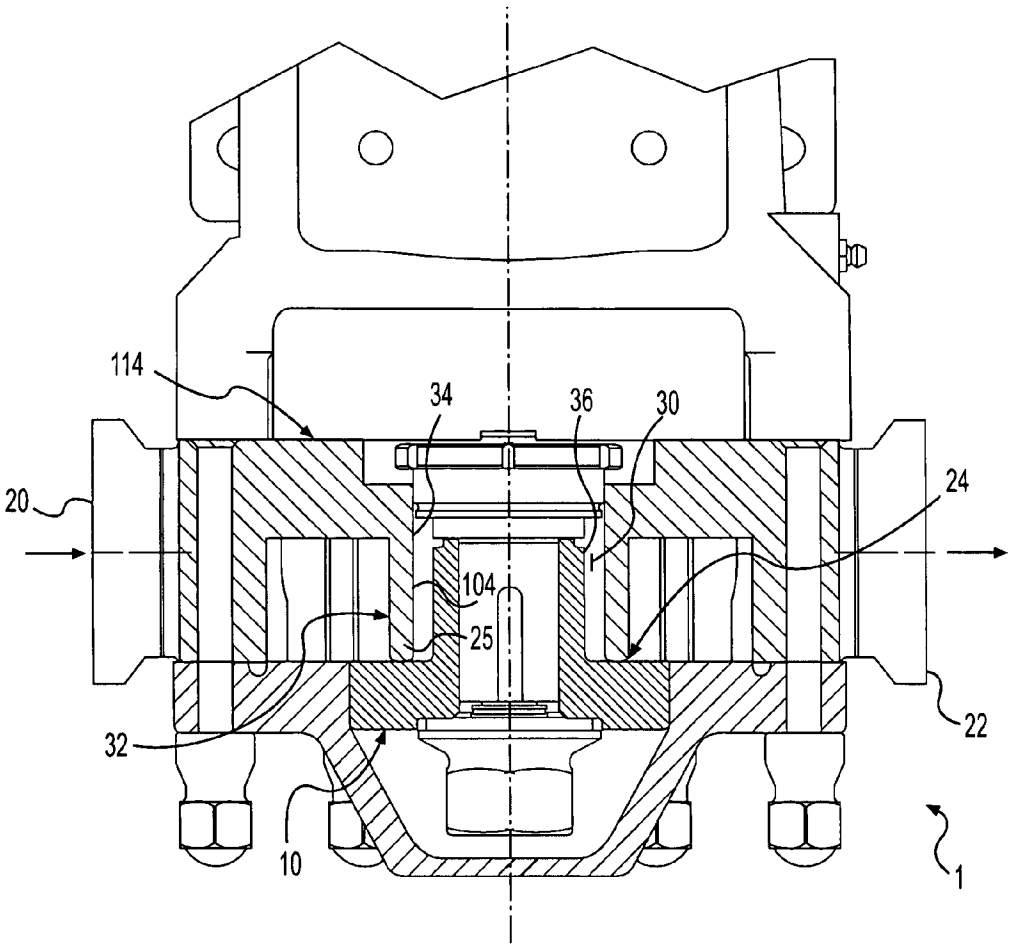
PRIOR ART FIG. 6
FIG. 6 is a sectional view, taken through line 1-1 in FIG. 5, of the pump of FIG. 4.

FIG. 1 is a cross-sectional view of a first preferred embodiment of the present invention. Components in FIGS. 1 through 6 with like numbers refer to like parts as those with like numbers in FIGS. 4 through 6, except where differences are shown in the drawings or described in the specification herein.

In the embodiment of FIG. 1, the outer surface of the rotor shaft 40 has a shoulder 44 leading to an increased diameter region 46. Thus, the seal chamber 48 is in some cases smaller (compared to the device of FIG. 6), and the body hub clearance gap 50 leads to an additional bushing clearance gap 52. In addition, a suction vent port 54 penetrates through the body hub 56. There is a close clearance fit, or close tolerance fit, between the large diameter portion of the rotor shaft 40 and the inside diameter of the body hub 56. The close tolerance fit provides rotational sliding contact, or near-contact, between the shaft 40 and body hub 56, and also forms at least to some degree a seal at that fit area.

The combination of this close clearance fit, as well as the provision of the suction vent port 54, reduces the pressure in the seal chamber 48 in some cases compared to the prior art and thus reduces the hydraulic forces acting on the body hub clearance gap 50 and bushing clearance gap 52. This extends the service life of the seal formed by the body hub clearance gap 50 and the bushing clearance gap 52, and also reduces the amount of heat generated by that seal region.

Figure 2:
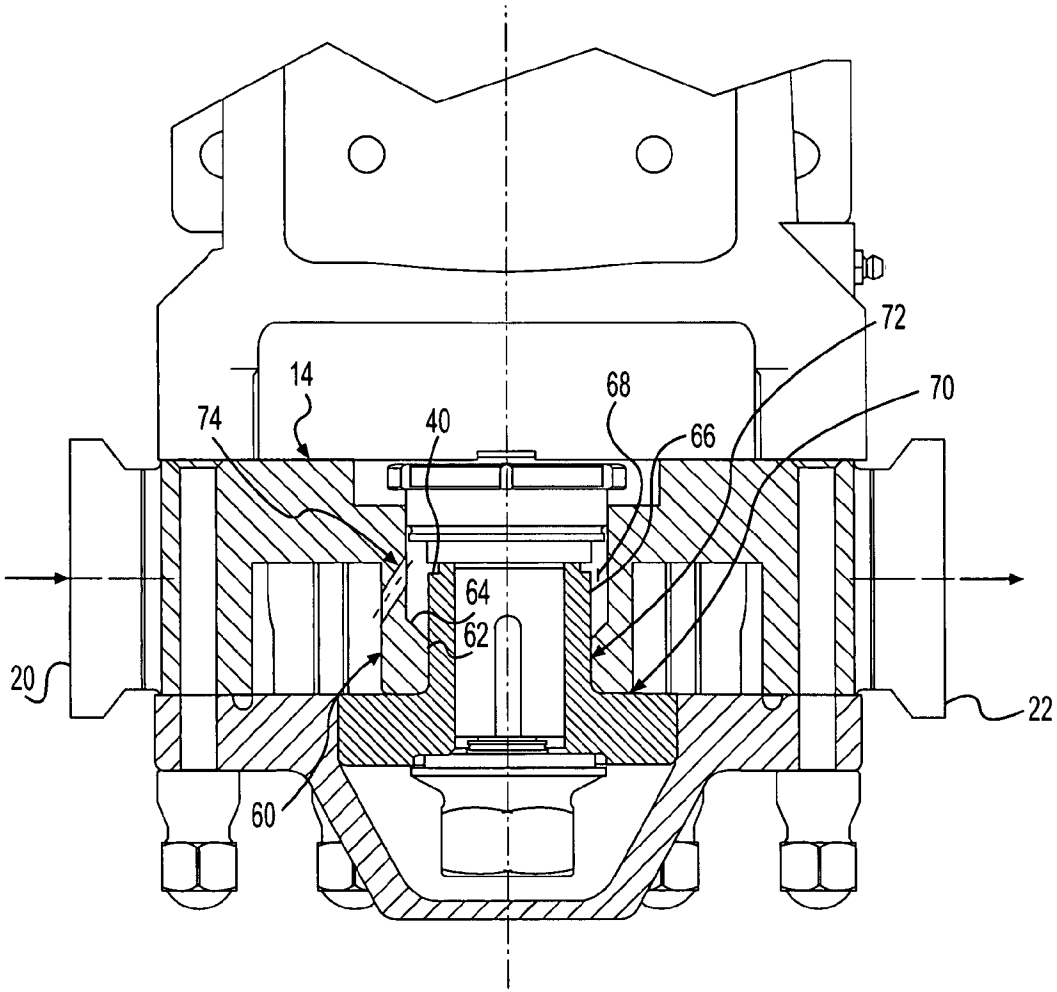
FIG. 2 is a sectional view, taken through line 1-1 in FIG. 5, of a second preferred embodiment of the present invention.

Turning to FIG. 2, a second preferred embodiment is illustrated. In this second preferred embodiment, the body hub 60 is provided with a shoulder 64 that leads to a reduced inside diameter area 62 of the body hub 60. A close clearance fit, or close tolerance fit, exits between the reduced diameter area 62 of the body hub 60 and the outer diameter face 66 of the rotor 10. The close tolerance fit provides rotational sliding contact, or near-contact, between the shaft 40 and body hub 60, and also forms at least to some degree a seal at that fit area. This arrangement also provides a seal chamber 68 which is in some cases smaller than the seal chamber 30 in the prior art of FIG. 6. Further, the body hub clearance gap 70 and the bushing clearance gap 72 are provided as shown.

Somewhat similar to the embodiment of FIG. 1, this embodiment in some cases reduces seal chamber pressure and thus can extend seal life compared to the prior art. This embodiment also has a suction vent port 74 penetrating through the body hub 60.

Figure 3:
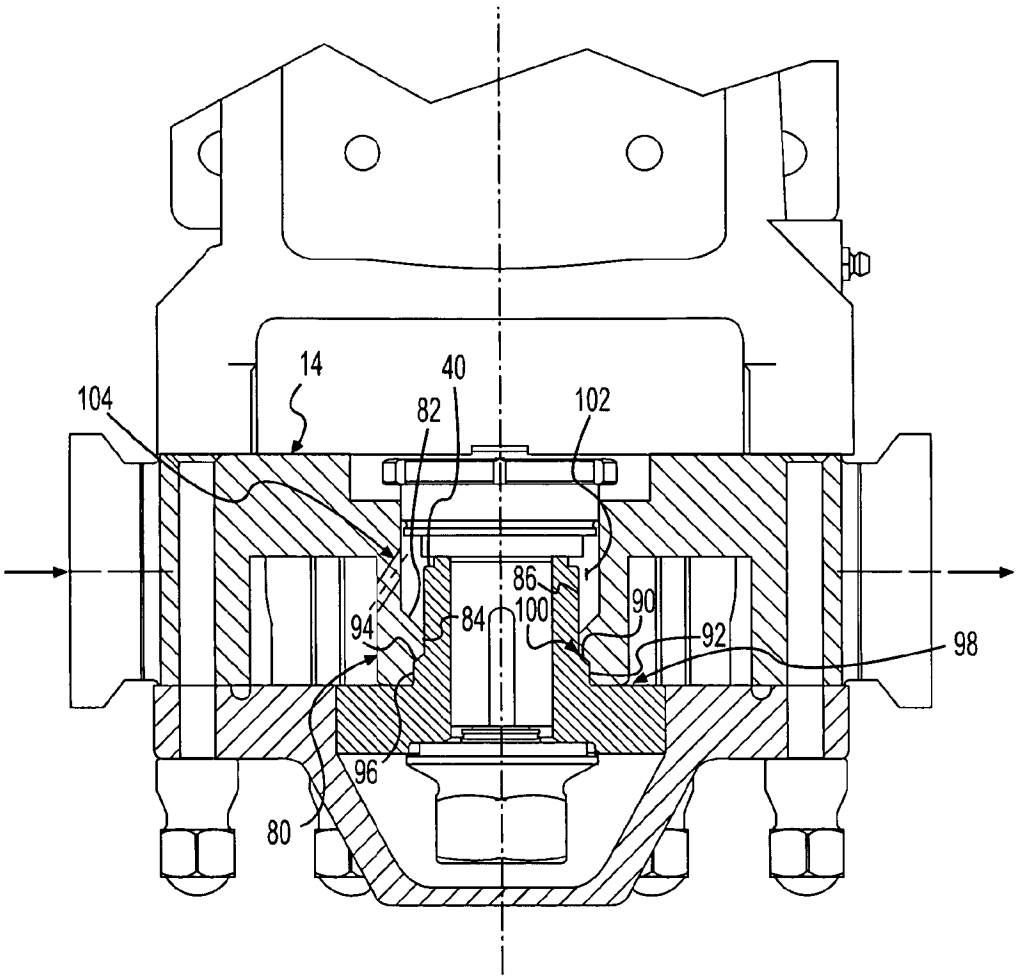
FIG. 3 is a sectional view, taken through line 1-1 in FIG. 5, of a third preferred embodiment of the present invention.

A third preferred embodiment is illustrated in FIG. 3. In this third preferred embodiment, the body hub 80 is provided with a first shoulder 82 that leads into a reduced internal diameter region 84. The reduced internal diameter region 84 has a close clearance fit, or close tolerance fit, with a first reduced outside diameter face 86 of the rotor shaft 40. The close tolerance fit provides rotational sliding contact, or near-contact, between the shaft 40 and body hub 80, and also forms at least to some degree a seal at that fit area. The rotor shaft 40 also has a shoulder 90 that leads to an increased outer diameter face region 92. The body hub 80 has a corresponding shoulder 94 that leads to an increased internal diameter region 96. A close clearance fit, or close tolerance fit, is provided between the respective rotor and body hub faces 84, 86, 92, 96, thus producing a body hub clearance gap 98 and a bushing clearance gap 100, as well as a seal chamber 102 which is in some cases reduced in size compared to the prior art. This embodiment also has a suction vent port 104 penetrating through the body hub 80.

In each of the embodiments described above, the suction vent port feature 54, 74, 104 is optional. However, the utilization of the suction vent port 54, 74, 104 together with the hub and/or rotor features disclosed above can improve performance compared to an otherwise identical device without the suction vent port feature. When the suction vent port is added, in some instances, the pump efficiency will be reduced because increased slip results in less pump output. However, the modified rotor embodiment, described as the first embodiment above, and illustrated in FIG. 1, serves both to further reduce seal pressure and also increase pump efficiency. The body modification embodiment, described as the second embodiment above, and illustrated in FIG. 2, reduces seal pressure and in some instances can maintain pump performance at the level of an unmodified pump.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pump, comprising:

a body forming a chamber;

at least one rotor rotating in the chamber, the rotor having a shaft with a cylindrical outward face that has a first outer diameter portion and a second outer diameter portion, with a shoulder between the first outer diameter portion and the second outer diameter portion; and a body hub portion extending from the body and oriented axially and having a cylindrical inner diameter face in rotational sliding contact with one of the first or second outer diameter portions of the shaft, wherein a bushing clearance gap is defined at the contact between the inner diameter face of the body hub and the second outer diameter portion of the rotor shaft, and wherein the rotor has a circular axial facing surface and the body hub has an end facing axially that slidingly contacts the axial facing surface of the rotor to define a body hub clearance gap, further wherein the rotor and the body hub portion define between them a seal chamber, and wherein the body hub has a suction vent port penetrating the hub from the seal chamber.

2. The pump of claim 1, wherein the diameter of the second outer diameter portion of the rotor shaft is larger than the diameter of the first outer diameter portion of the rotor shaft.

3. The pump of claim 1, wherein the bushing clearance gap and the body hub clearance gap each have a respective close tolerance fit.

4. The pump of claim 1, wherein the bushing clearance gap and the body hub clearance gap each define respective sliding frictional seal regions.

5. A pump, comprising:

means for defining a chamber;

pumping means comprising at least one rotor rotating in the chamber, the rotor having a shaft with a cylindrical outward face that has a first outer diameter portion and a second outer diameter portion, with a shoulder between the first outer diameter portion and the second outer diameter portion; and a body hub extending in the chamber and oriented axially and having a cylindrical inner diameter face in rotational sliding contact with one of the first or second outer diameter portion of the shaft, wherein a bushing clearance gap is defined at the contact between the inner diameter face of the body hub and the second outer diameter portion of the rotor shaft, and wherein the rotor has a circular axial facing surface and the body hub has an end facing axially that slidingly contacts the axial facing surface of the rotor to define a body hub clearance gap, further wherein the rotor and the body hub portion define between them a seal chamber, and wherein the body hub has a suction vent port penetrating the hub from the seal chamber.

6. The pump of claim 5, wherein the diameter of the second outer diameter portion of the rotor shaft is larger than the diameter of the first outer diameter portion of the rotor shaft.

7. The pump of claim 5, wherein the bushing clearance gap and the body hub clearance gap each define respective sliding frictional seal regions.

8. The pump of claim 5, wherein the bushing clearance gap and the body hub clearance gap each have a respective close tolerance fit.

9. A pump, comprising:

a body forming a chamber;

at least one rotor rotating in the chamber, the rotor having a shaft portion having a cylindrical outward face; and a body hub extending from the body and oriented axially and having a cylindrical inner diameter face having a third inner diameter portion and a fourth inner diameter portion, with a shoulder between the third inner diameter portion and the fourth inner diameter portion, and the third inner diameter portion in rotational sliding contact with the outward face of the shafts wherein a bushing clearance gap is defined at the contact between the inner diameter face of the body hub and the second outer diameter portion of the rotor shaft, and wherein the rotor has a circular axial facing surface and the body hub has an end facing axially that slidingly contacts the axial facing surface of the rotor to define a body hub clearance gap, further wherein the rotor and the body hub portion define between them a seal chamber, and wherein the body hub has a suction vent port penetrating the hub from the seal chamber.

10. The pump of claim 9, wherein the diameter of the third inner diameter portion of the rotor shaft is smaller than the diameter of the fourth inner diameter portion of the rotor shaft.

11. The pump of claim 9, wherein the bushing clearance gap and the body hub clearance gap each have a respective close tolerance fit.

12. The pump of claim 9, wherein the bushing clearance gap and the body hub clearance gap each define respective sliding frictional seal regions.

13. A pump, comprising:

means for defining a chamber;

pumping means comprising at least one rotor rotating in the chamber, the rotor having a shaft with a cylindrical outward face; and a body hub extending from the body and oriented axially and having a cylindrical inner diameter face having a third inner diameter portion and a fourth inner diameter portion, with a shoulder between the third inner diameter portion and the fourth inner diameter portion, and the third inner diameter portion in rotational sliding contact with the outward face of the shaft, wherein a bushing clearance gap is defined at the contact between the inner diameter face of the body hub and the second outer diameter portion of the rotor shaft, and wherein the rotor has a circular axial facing surface and the body hub has an end facing axially that slidingly contacts the axial facing surface of the rotor to define a body hub clearance gap, further wherein the rotor and the body hub portion define between them a seal chamber, and wherein the body hub has a suction vent port penetrating the hub from the seal chamber.

14. The pump of claim 13, wherein the diameter of the third inner diameter portion of the rotor shaft is smaller than the diameter of the fourth inner diameter portion of the rotor shaft.

15. The pump of claim 13, wherein the bushing clearance gap and the body hub clearance gap each have a respective close tolerance fit.

16. The pump of claim 13, wherein the bushing clearance gap and the body hub clearance gap each define respective sliding frictional seal regions.

17. A method of pumping material using at least one rotor in a body forming a chamber, comprising:

rotating at least one rotor in the chamber, the rotor having a shaft with a cylindrical outward face that has a first outer diameter portion and a second outer diameter portion, with a shoulder between the first outer diameter portion and the second outer diameter portion, wherein the body has a body hub extending from the body and oriented axially and having a cylindrical inner diameter face in rotational sliding contact with one of the first or second outer diameter portions of the shaft, wherein a bushing clearance gap is defined at the contact between the inner diameter face of the body hub and the second outer diameter portion of the rotor shaft, and wherein the rotor has a circular axial facing surface and the body hub has an end facing axially that slidingly contacts the axial facing surface of the rotor to define a body hub clearance gap, further wherein the rotor and the body hub portion define between them a seal chamber, and wherein the body hub has a suction vent port penetrating the hub from the seal chamber.

18. A method of pumping material using at least one rotor in a body forming a chamber, comprising:

rotating at least one rotor in the chamber, the rotor having a shaft portion with a cylindrical outward face, wherein the body has a body hub extending from the body and oriented axially and having a cylindrical inner diameter face having a third diameter portion and a fourth diameter portion, with a shoulder defined between the third diameter portion and the fourth diameter portion, and the third diameter portion in rotational sliding contact with the outward face of the shaft, wherein a bushing clearance gap is defined at the contact between the inner diameter face of the body hub and the second outer diameter portion of the rotor shaft, and further wherein the rotor has a circular axial facing surface and the body hub has an end facing axially that s1idingly contacts the axial facing surface of the rotor to define a body hub clearance gap, wherein the rotor and the body hub portion define between them a seal chamber, and wherein the body hub has a suction vent port penetrating the hub from the seal chamber.

* * * * *

UNITED STATES PATENT AND TRADEMARK OFFICE

CERTIFICATE OF CORRECTION

PATENT NO. : 7,563,087 B2
APPLICATION NO. : 11/405525
DATED : July 21, 2009
INVENTOR(S) : Drew J. Van Norman and Curt Hagen It is certified that error appears in the above-identified patent and that said Letters Patent is hereby corrected as shown below:

Column 6, line 42, please change "shafts wherein" to --shaft, wherein--;
Column 8, line 29, please change "s1idingly contacts" to --slidingly contacts--.

Signed and Sealed this

Twenty-fifth Day of August, 2009

David J. Kappos

David J. Kappos
*Director of the United States Patent and Trademark Office*